US007413476B2

(12) United States Patent
Ma

(10) Patent No.: US 7,413,476 B2
(45) Date of Patent: Aug. 19, 2008

(54) ELECTRICAL INTERCONNECTION WITH MATING TERMINALS

(75) Inventor: Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/825,899

(22) Filed: Jul. 10, 2007

(65) Prior Publication Data

US 2008/0009195 A1 Jan. 10, 2008

(30) Foreign Application Priority Data

Jul. 10, 2006 (TW) ..... 95125034 A

(51) Int. Cl.
*H01R 24/00* (2006.01)

(52) U.S. Cl. ..... 439/637; 439/352

(58) Field of Classification Search ..... 439/62, 439/65, 352, 636, 637
See application file for complete search history.

(56) References Cited

U.S. PATENT DOCUMENTS 4,813,881 A * 3/1989 Kirby ..... 439/74
5,626,483 A * 5/1997 Naitoh ..... 439/74
5,788,539 A * 8/1998 Fedder ..... 439/682
5,885,092 A * 3/1999 Ito et al. ..... 439/74
6,702,590 B2 * 3/2004 Zaderej et al. ..... 439/74
6,746,281 B1 * 6/2004 Zhang ..... 439/637
2002/0142629 A1 * 10/2002 Zaderej et al. ..... 439/74
2004/0214457 A1 * 10/2004 Ma ..... 439/74
2008/0009195 A1 * 1/2008 Ma ..... 439/637

* cited by examiner

*Primary Examiner*—James Harvey
(74) *Attorney, Agent, or Firm*—Wei Te Chung

(57) ABSTRACT

An electrical interconnection (100) includes a plug connector (1) and a receptacle connector (2) mated with each other, each connector including terminals thereof. Every two adjacent terminals (12, 21) of each connector have mating sections (124, 224) disposed in an opposed relationship with each other such that when the plug connector mates with the receptacle connector, mating forces of the mating sections of the plug connector and the receptacle connector are substantially equal to zero. As such, there is no damage happens to an insulative body of the plug connector or the receptacle connector, which is set for holding the respective terminals.

2 Claims, 3 Drawing Sheets

ELECTRICAL INTERCONNECTION WITH MATING TERMINALS

BACKGROUND OF THE INVENTION

1. Field of the Invention

The present invention relates to the art of electrical connectors, and more particularly to an electrical interconnection including a pair of mated connectors placed between two parallel circuit boards.

2. Description of the Related Art

An electrical interconnection including a pair of mated connectors is placed between two parallel circuit boards for establishing electrical continuity between the two circuit boards. In generally, one of the mated connectors includes a plurality of contact terminals arranged in a series of adjacent columns, with mating sections structurally different than mating sections of deflectable terminals of the other connector and adapted for electrically mating with the respective mating sections of the other connector. A problem with a conventional electrical interconnection is that greater mating forces generated during mating the terminals of the first connector with the terminals of the second connector will result in the crack or damage of an insulative housing, which is set for holding the terminals of the first connector or the second connector. It is contemplated that a suitable arrangement of the terminals between the first connector and the second connector is set in order to reduce the mating forces therebetween, thereby preventing the insulative housings of the first connector and the second connector from being damaged.

SUMMARY OF THE INVENTION

One embodiment of an electrical interconnection includes a first connector and a second connector mated with each other. The first connector includes a connector body having a base and a mating interface, with a plurality of blade-type contact terminals extending from the base and past said mating interface. Every two adjacent contact terminals of the first connector have mating sections disposed in an opposed relationship with each other. A second connector includes a body for mating with the first connector at the mating interface, and has a base with a plurality of beam-type contact terminals held therein for mating with the blade-type contact terminals of the first connector, wherein a mating section of each terminal of the second connector is structurally different than the mating section of the terminal of the first connector. Every two adjacent contact terminals of the second connector have the mating sections thereof disposed in opposed relationship with each other such that mating forces of the mating sections of the first connector and the second connector are substantially equal to zero when the first connector mates with the second connector. As such, since the mating forces between the first connector and the second connector are substantially equal to zero, there is no damage to the insulative body of the first connector and/or the second connector, which are set for holding the respective beam-type contact terminals or blade-type contact terminals.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
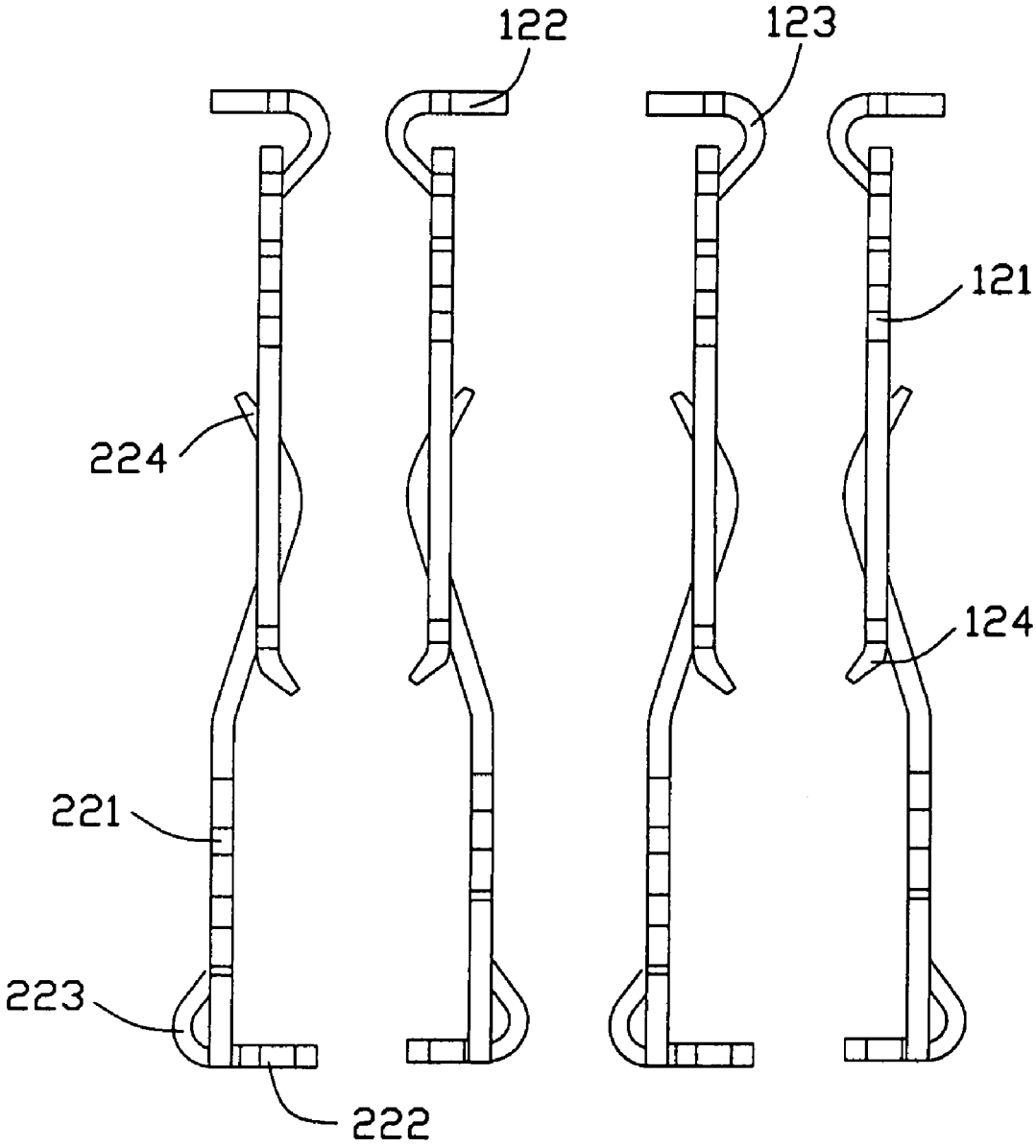
FIG. 1 is a sketch view showing arrangement of terminals in an electrical interconnection according to a preferred embodiment.
Figure 2:
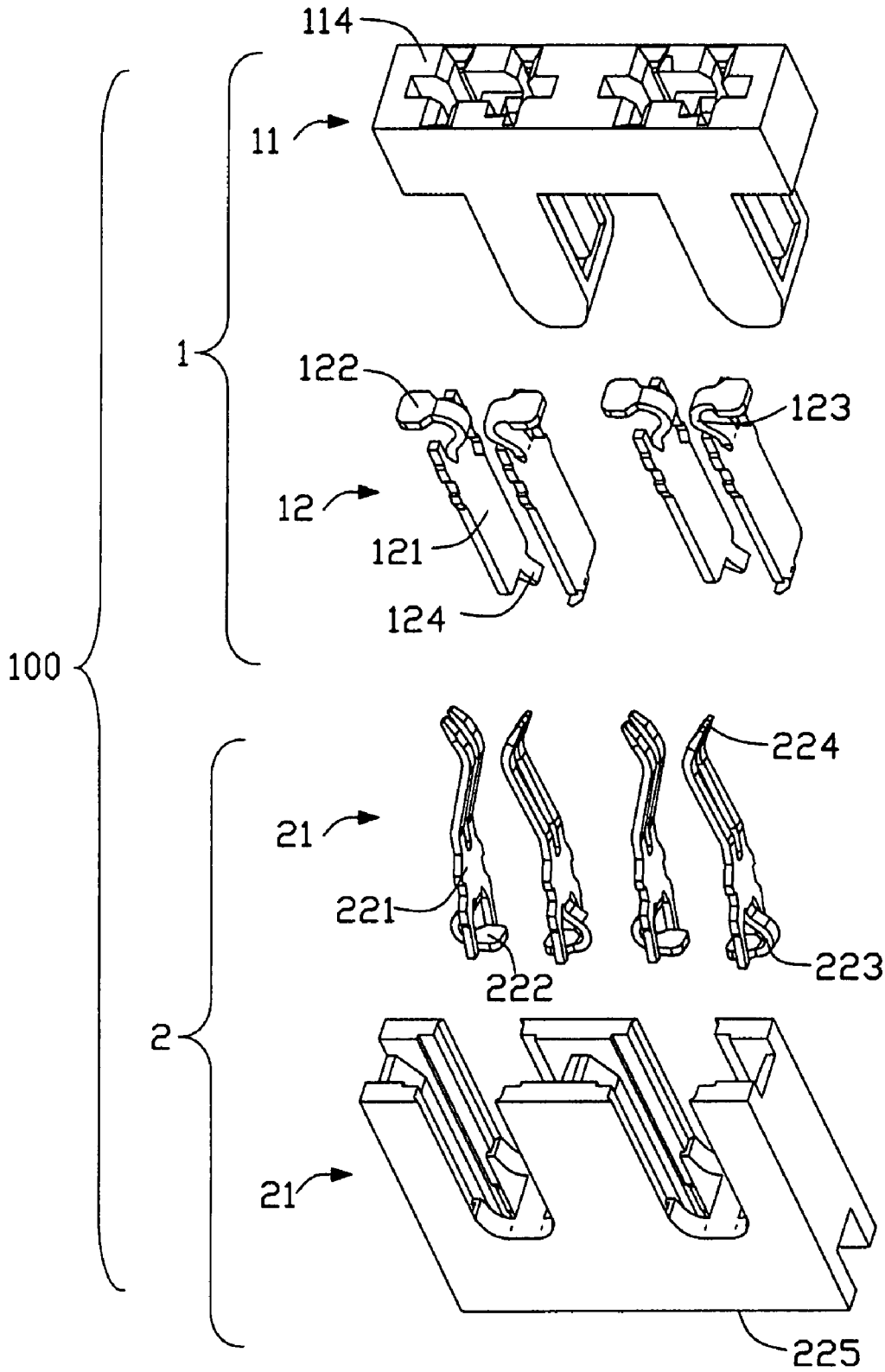
FIG. 2 is an exploded, perspective view of a part of the electrical interconnection.
Figure 3:
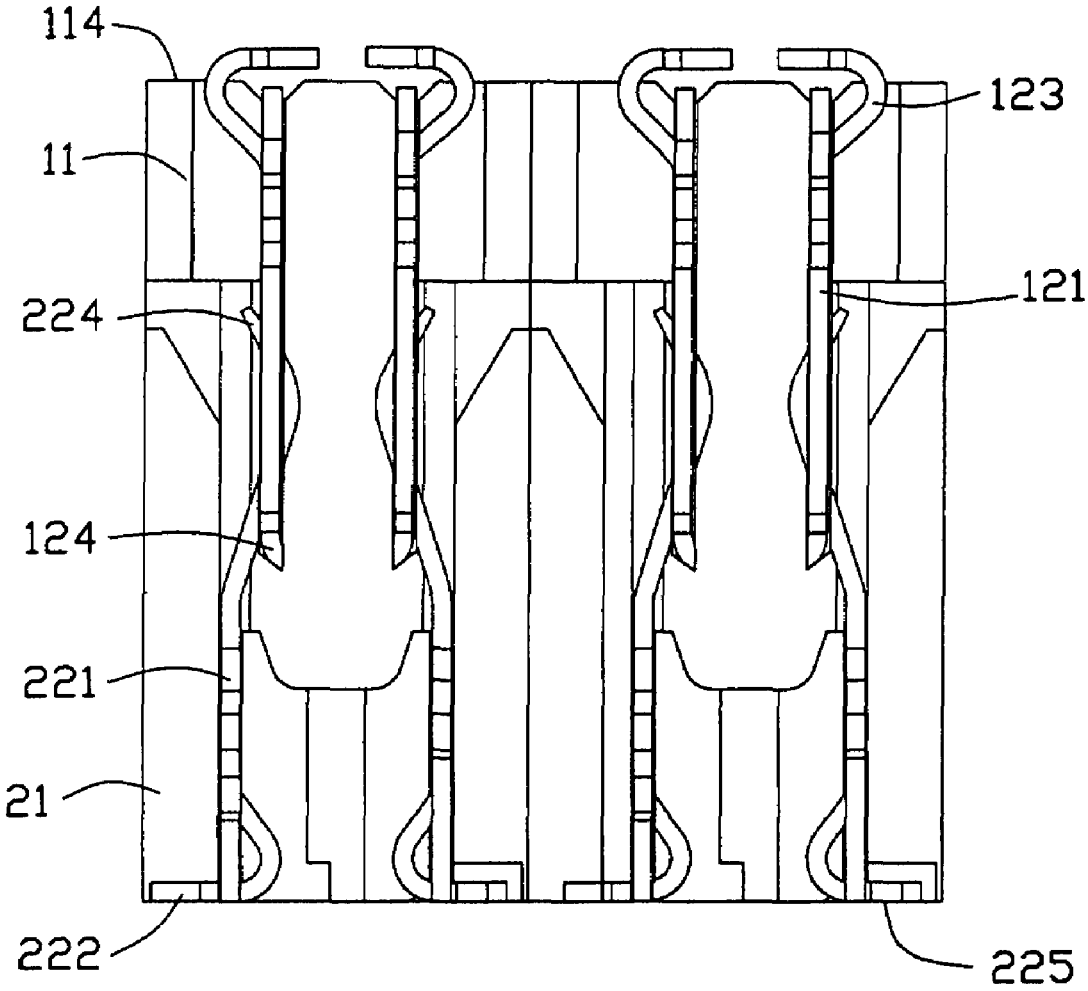
FIG. 3 is an assembled, front view of another part of the electrical interconnection of FIG. 2.

Referring to FIGS. 1 to 3, a preferred embodiment of an electrical interconnection 100 is shown for establishing electrical continuity between two parallel circuit boards (not shown). The electrical interconnection 100 includes a pair of mated connectors including a plug connector 1 and a receptacle connector 2. The receptacle connector 2 includes an insulative connector body 22 having a base with a mating interface and an opposite mounting interface 225. A plurality of beam-type contact terminals 21 is arranged in a series of adjacent columns, with each having a base portion 221 residing in a plane and adapted for being secured in the connector body 22. The beam-type contact terminal 21 of the receptacle connector 2 further includes a mounting portion 222 extending towards the mounting interface 225 of the connector body 22 and adapted for engaging a contact of one of the parallel circuit boards, with a neck portion 223 attached to the mounting portion 222 and angled with respect to the plane of the base portion 221 of the terminal 21 of the receptacle connector 2. Each of the terminals 21 of the receptacle connector 2 includes a mating portion 224 located opposite to the mounting portion 222 and adapted for electrically mating with a mating section 124 of a respective terminal 12 of the plug connector 1 (to be later described). Mating portions 224 of the terminals 21 of the receptacle connector 2 are arranged such that every two adjacent contact terminals 21 have their mating portions 224 disposed in an opposed relationship with each other.

The plug connector 1 includes an insulative body 11 for mating with the receptacle connector 2 at the mating interface, and has a base with a mounting face 114 for facing another circuit board. A plurality of blade-type contact terminals 12 is arranged in correspondence with the respective beam-type terminals 21 of the receptacle connector 2 for electrically mating with the receptacle connector beam-type terminals 21. Each of the contact terminals 12 has a base section 121 residing in a plane and adapted to be secured in the body 11 of the plug connector 1. The contact terminal 12 further includes a mounting section 122 extending out of the mounting face 114 of the plug connector 1 and adapted for engaging a conductive terminal of the another circuit board, with a neck section 123 attached to the mounting section 122 and angled with respect to the plane of the base section 121 of the contact terminal 12 of the plug connector 1. Each of the terminals 12 of the plug connector 2 includes the mating section 124 located opposite to the mounting section 122 and adapted for electrically mating with the mating portion 224 of the respective terminal 21 of the receptacle connector 2. Every two adjacent contact terminals 12 of the plug connector 1 have their mating section 124 disposed in an opposed relationship with each other such that mating forces of the mating portions 224 of the receptacle connector 2 and the mating sections 124 of the plug connector 1 is substantially equal to zero when the plug connector 1 mates with the receptacle connector 2. As such, since the mating forces between the receptacle connector 2 and the plug connector 1 are substantially equal to zero, there is no damage happens to the insulative body of the receptacle connector 2 and/or the plug connector 1, which are set for holding the respective beam-type contact terminals 21 or blade-type contact terminals 12.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical interconnection comprising:

a first connector comprising:

a connector body having a base and a mating interface;

a plurality of blade-type contact terminals extending from the base and past said mating interface, every two adjacent contact terminals having mating sections disposed in an opposed relationship with each other;

a second connector comprising:

a body for mating with the first connector at said mating interface and having a base; and a plurality of beam-type contact terminals for mating with the blade-type contact terminals of the first connector with a mating section of each terminal of the second connector structurally different than said mating section of the terminal of the first connector, every two adjacent contact terminals of the second connector having said mating sections disposed in opposed relationship with each other such that mating forces of said mating sections of the first connector and the second connector are substantially equal to zero when the first connector mates with the second connector;

wherein the second connector includes a mounting portion extending towards a mounting interface opposite to the mating interface of the second connector.

2. An electrical interconnection system comprising:

a first connector including a first insulative housing defining two spaced receiving cavities, each of said receiving cavities being equipped with a pair of first terminals by two sides in a mirror image arrangement along a mating direction; and a second connector including a second insulative housing defining two spaced protrusions, each of said protrusions being equipped with a pair of second terminals by two sides in a mirror image arrangement along a mating direction; wherein the protrusion is snugly inserted into the corresponding receiving cavity and the pair of first terminals respectively engage the corresponding pair of second terminals under a condition that interactive forces occur between the first terminals and the second terminals on said two sides of the protrusion and the corresponding receiving cavity are counterbalanced;

wherein each solder tail of the pair of first terminals in each of said receiving cavities extends inwardly with respect to a center of each respective cavity and each solder tail of the pair of second terminals extend away from each respective protrusion.

* * * * *